US005873500A

United States Patent [19]

Homburg et al.

[11] Patent Number: 5,873,500

[45] Date of Patent: Feb. 23, 1999

[54] FLUID DELIVERY CART

[75] Inventors: Richard W. Homburg, Lumberton; Jay A. Murray, MAFB, both of N.J.

[73] Assignee: The United States of America as represented by the Secretary of the Air Force, Washington, D.C.

[21] Appl. No.: 660,563

[22] Filed: Jun. 7, 1996

[51] Int. Cl.[6] ..... B67D 5/64

[52] U.S. Cl. ..... 222/608; 222/399

[58] Field of Search ..... 222/608, 394, 222/399, 23

[56] References Cited

U.S. PATENT DOCUMENTS 4,359,073 11/1982 De Stoutz ..... 222/608 X 5,494,191 2/1996 Benson ..... 222/23

5,628,431 5/1997 Roach et al. ..... 222/608 X

*Primary Examiner*—Gregory L. Huson

*Attorney, Agent, or Firm*—Thomas C. Stover

[57] ABSTRACT

A cart is provided for delivering fluid to vehicles including aircraft. The fluid can be, e.g., engine oil or hydraulic fluid. The cart has a tank, mounted to a carriage mounted in turn to carrying wheels. The cart has as a dispensing means, a hose ending in a nozzle. Fluid, e.g. oil is added to the tank, followed by an inert gas, e.g., $N_2$, which pressurizes the tank to about 120 psi. The cart is wheeled to an aircraft and oil delivered to its engines through the dispense means. Such delivery system replaces delivery by quart cans or by mechanical pumps, which have had inefficiency, waste and contaminant drawbacks.

11 Claims, 2 Drawing Sheets

FLUID DELIVERY CART

STATEMENT OF GOVERNMENT INTEREST

The invention described herein may be manufactured and used by or for the Government for governmental purposes without the payment of any royalty thereon.

FIELD OF THE INVENTION

This invention relates to a means for delivering fluid to vehicles, particularly a cart for delivering same.

BACKGROUND OF THE INVENTION

The prior art method for adding oil to engines has been from quart cans, one can at a time. There are several disadvantages to this method. For example one Air Force Bases can use 50,000 to 67,000 quarts annually, to service C141 aircraft and almost every one of these cans will go into the solid waste stream (a certain number of these cans fly off station with the aircraft and don't come back). Using cans also results in waste whenever a full quart is not needed, which is the case many times. Any unused serviceable oil must be disposed of in waste oil bowsers which then becomes hazardous waste. Handling this volume of cans is also manpower intensive from cradle to grave. All the cases of oil are hand-carried and each can must be accounted for one for one. Along the logistics trail these are subject to damage or crushing leaving organizations subject to local, state or federal environmental law violations.

Also in the prior art oil servicing means have been employed. See for examples, U.S. Pat. No. 5,289,900 to Aho, Jr., et (1994) and U.S. Pat. No. 5,494,191 to Benson (1996). Both of these oil deliveries systems employ mechanical pump pressure to deliver oil which can add contaminants thereto as the pump components wear.

Accordingly there is need and market for a fluid delivery means that overcomes the above prior art shortcomings.

SUMMARY OF THE INVENTION

Broadly the present invention provides a cart for delivering fluid which includes, a) a tank for the fluid and b) carrying wheels mounted to the tank.

The fluid cart also has c) inlet means to add fluid to the tank, d) dispense means to dispense fluid from the tank, e) charge means to add gas to the tank to pressurize same to push fluid therefrom through the dispense means, when it is opened and f) means to open and close the dispense means. Can also efficiently deliver oil to engine.

By "fluid" as used herein is meant oils including engine oil and hydraulic fluid.

BRIEF DESCRIPTION OF THE DRAWINGS

The invention will become more apparent from the following detailed specification and drawings in which.

DESCRIPTION OF PREFERRED EMBODIMENTS

Figure 1:
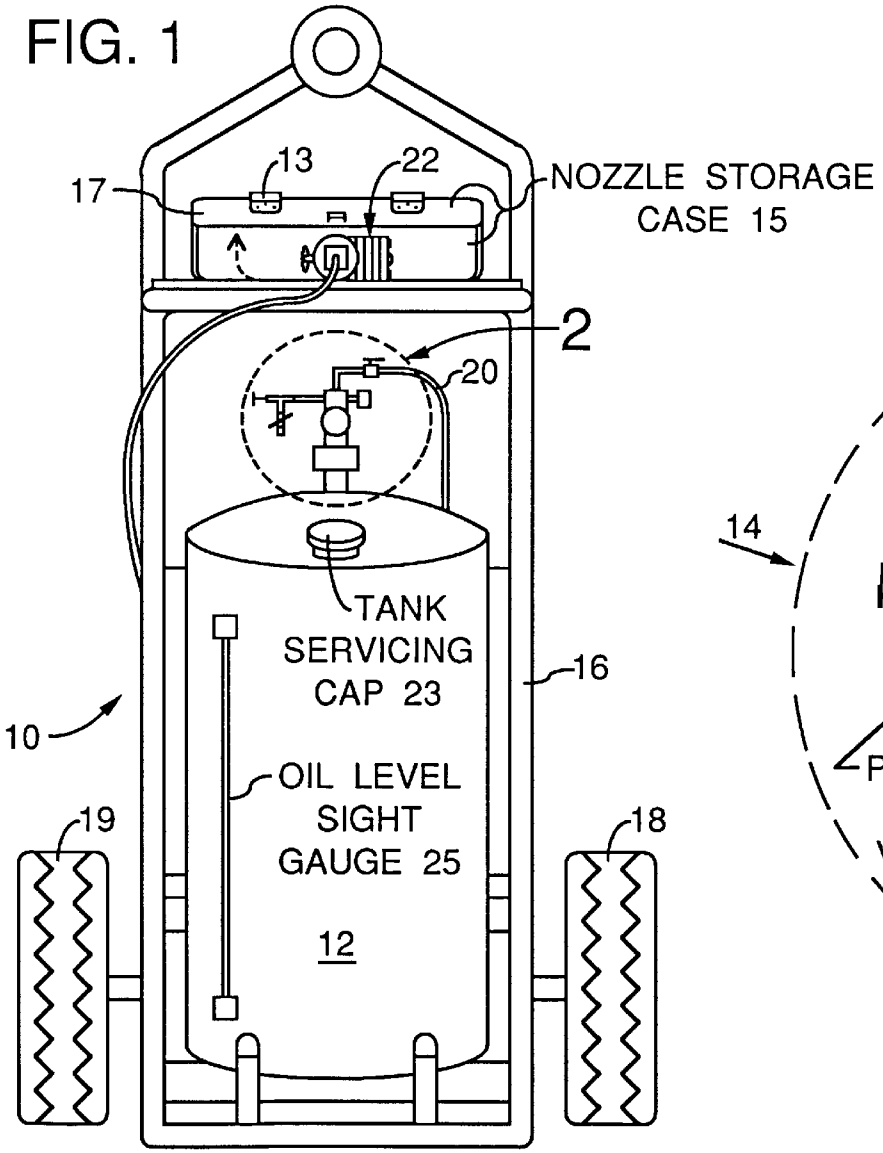
FIG. 1 is a plan schematic view of a cart embodying the present invention.
Figure 2:
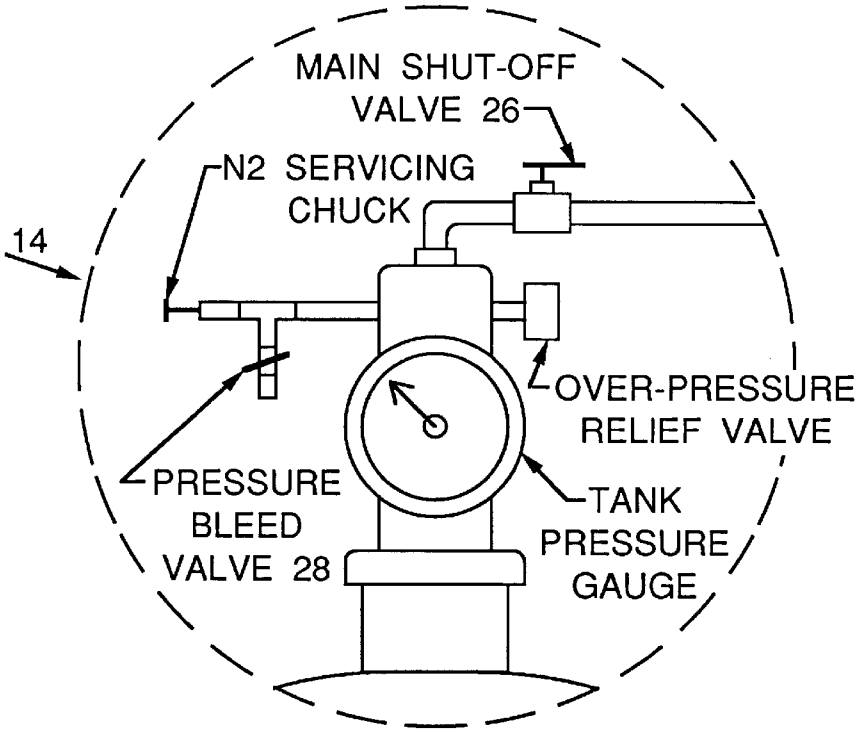
FIG. 2 is an enlarged fragmentary schematic view of manifold components of the cart of FIG. 1.

Referring in more detail to the drawings, the cart 10 of the invention includes the following components per FIGS. 1 to 4: a 17 gallon pressurized tank 12, a manifold 14 with gauges and valves, a transportation carriage 16 with two air filled tires 18 and 19, a retractable 49 ft hose 20 and a drip-free nozzle 22 with double quantity counters 24 and 25. Together these comprise the cart 10 that holds e.g., 35 quarts of fluid, e.g. usable oil pressurized to, e.g. 120 psi with gaseous nitrogen ($N_2$). This quantity of oil is capable of servicing an average of 10 aircraft before it needs to be refilled. The user is able to control the amount of oil being put into each engine and can read from its counters how much oil has been delivered (aircraft maintenance manuals require such entries).

The cart 10 is built to be stored on a ready line where other support equipment is held until needed. When needed it is towed behind a flight line vehicle and delivered to an aircraft parking spot. It is then pulled by hand, e.g., by one person, to the engine that needs servicing. The nozzle 22 is removed from its storage case 15 after opening the portal 17 (per arrow 11) on its hinge 13, per FIGS. 1 and 3. The nozzle 22 is then pulled out to the limit of it's hose 20 and set, e.g. on a maintenance stand (not shown). The length of hose 20 allows the nozzle 22 to reach two engines (on the same wing) without the cart 10 having to be moved. The main shut-off valve 26, on the cart manifold, is then opened, giving pressure to the nozzle 22. The technician holds the nozzle 22 to the engine servicing port (not shown) and squeezes the handle 32, releasing oil, through the spot 21 until the engine is full. Once the engine is serviced, the counters are read, indicating the amount of oil delivered.

Figure 4:
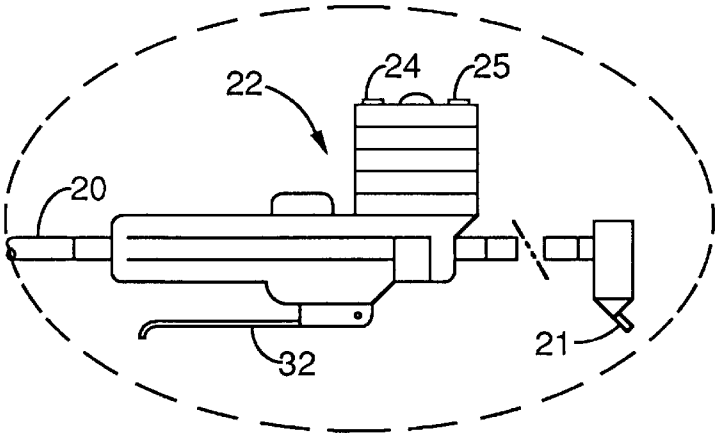
FIG. 4 is enlarged fragmentary elevation schematic view of components of the cart shown in FIGS. 1 and 3.
Figure 3:
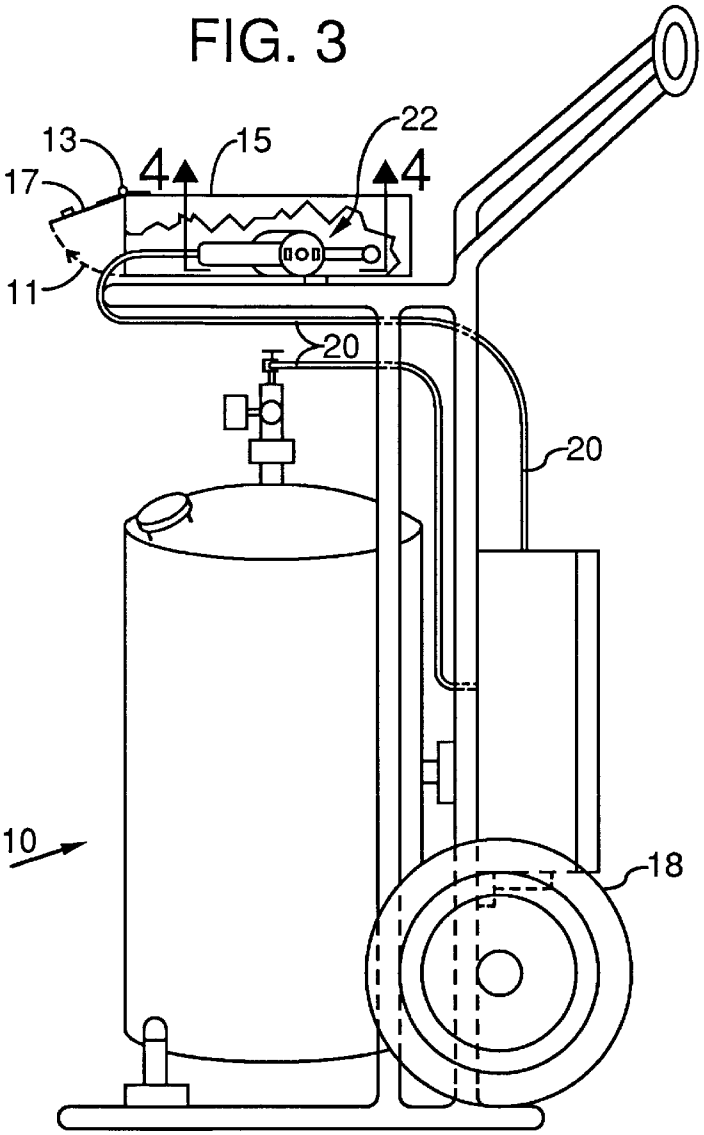
FIG. 3 is an elevation schematic view of the cart of the invention shown in FIG. 1

The nozzle 22 has two counters, 24, and 25 per FIG. 4, one resetable (25) and one non-resetable (24), which facilitates monitoring the amount of use a cart has through time. The technician then resets the counter 25 to zero, making it ready for the next engine. Once the aircraft servicing is complete, the main shut-off valve 26 is closed, hose retracted, nozzle stowed and cart towed back to the ready line. This process is repeated until the cart 10 is empty of oil, at which time it is towed to the bulk service area where, e.g. up to 4,000 gallons of engine oil is available.

The cart 10 is supported by procuring oil in bulk and having it stored in e.g., a 4,000 gallon, above-ground double walled container (not shown) located near the flight line. The bulk oil system (not shown) is made up of the following components; sealed double walled, above-ground container, air operated pump, hose and nozzle, shut-off valves, pressure relief valve, check valve, pressure gauges, pressure regulators and a supply of $N_2$. The engine oil is delivered from the supplier, sampled, then unloaded into the bulk container.

The process for the bulk storage is as follows; it operates off a supply of $N_2$ which is available in bottle form, e.g. at 3,000 psi and 260 cubic feet. The $N_2$ is piped into the bulk container and regulated to keep it pressurized at, e.g. at 0.5 psi. This is to keep outside moisture and airborne contaminates from being drawn into the bulk container as the level of oil drops. These contaminates would eventually degrade the quality of the oil and even the steel lining of the container. The $N_2$ source is also regulated to about 90 psi to operate the pump mounted on the bulk container. The pump transfers the oil to the cart 10 with e.g., the same type of nozzle found on the cart 10. When the cart 10 is out of oil, it must be reserviced. The user tows the cart 10 to the servicing area and readies it by depleting any remaining $N_2$ pressure. This is accomplished by opening the pressure bleed valve 28 of FIG. 2. The tank servicing cap 23 (of FIG. 1) is then opened and engine oil is poured into a predetermined level (e.g. at 35 quarts) which the user can see from the sight gauge 25 on the side of the tank 12. Once the cart 10 is serviced, the bulk container pump is shut down and it's nozzle stowed. The cart is made ready to return to service by reinstalling the cap 23, closing the pressure bleed valve 28 and pressurizing the tank with $N_2$ regulated to, e.g. 120 psi.

The following example is intended to illustrate the invention and should not be construed in limitation thereof.

EXAMPLE I

A prototype oil cart was tested on a C-141 engine, TF-33. The test was done with an engine going into overhaul maintenance. Into a 17 gallon tank of the cart of the invention, 35 quarts of oil were added thereafter sufficient nitrogen was pumped in to pressurize the tank up to about 120 psi.

The engine first did a full power run and a sample of its original oil was taken. The oil was drained from the engine, which was then reserviced from the oil cart. A sample was taken from the oil cart prior to servicing the engine and a sample from a newly opened quart of oil. The engine was run again with the new oil in it and then another sample was taken therefrom. All the oil samples were tested at a Non-Destructive Inspection (NDI) Lab with a spectrum oil analysis. Lab tests confirm that the use of the oil cart did not contribute any more non-critical elements than by use of oil cans. The tests also confirm that the cart can deliver 25 quarts to an empty engine quicker (3 min.) and cleaner than by the prior art method, 1 quart at a time (20 min.).

The prototype oil cart was used on the flight line during a two week period and had favorable results. The cart wheeled easily from one aircraft to another. The operator was able to service, e.g. two engines on a wing, before having to roll up the hose and move the cart. The oil counter gave an accurate reading of the amount of oil serviced in each engine.

Thus the purpose of the engine oil servicing cart is to service, e.g. aircraft engines on the flight line or in hangars from a source other than quart cans. The method of the invention can eliminate a source of hazardous waste (unused serviceable oil) and eliminates a solid waste stream of thousands of quart cans per year.

The oil cart of the invention is capable of delivering, e.g. up to 35 quarts of oil or more as desired (depending on tank size) before being depleted. Once the oil cart of the invention is serviced with, e.g. 35 quarts of oil, it is pressurized to, e.g. 100 to 140 psi or more.

So pressurizing the oil serves two purposes, 1) it allows the cart to be operated by one person instead of two, no-one is needed to pump the oil and,
2) the inert gas does not contaminate the oil or components of the cart the way that e.g. compressed air would.

Also in pumping oil using a pressurized tank as described above, there is less likely hood of contaminants entering the so pumped oil than with prior art mechanical pumping systems as noted above.

In the pressurized tank of the invention; the ratio of oil to, e.g. $N_2$, is adjusted so that all the oil is utilized in the cart before the useable $N_2$ pressure drops off. The cart of the invention, has several gauges and valves to monitor and operate the separate functions thereof, e.g. per FIGS. 2 and 4 hereof.

As indicated, the oil in the tank is desirably pressurized by an inert gas, e.g. nitrogen, argon and the like.

Advantageously the oil nozzle of the oil cart of the invention is attached, e.g. to a 49 foot retractable hose and reel, although such hose can be shorter or longer as desired within the scope of the invention.

Advantages of the oil cart of the present invention are numerous, for example:

The system does not utilize electricity for operating any of its components

The inert gas preserves the integrity of the fluid and is the medium for pumping same.

The inert gas, e.g. $N_2$ is readily available in the aircraft maintenance field.

The cart of the invention eliminates waste generated from quarts that are partially used.

The inventive cart saves tracking and accounting for each can and

The cart is capable of refilling empty engines in less than 4 minutes by one person, where it takes 20 minutes and two people using quart cans for such filing, per the prior art.

The oil cart of the invention can be of various sizes to accommodate different requirements of various users. The pressurized tank of the oil cart of the invention is available in various sizes and its hose can come in a variety of lengths, diameters and pressure ratings.

In addition to delivery of engine oil to vehicles, the cart of the invention can also deliver hydraulic fluid to such vehicles including aircraft, civilian or military, within the scope of the present invention.

What is claimed is:

1. A fluid cart for delivering fluid comprising, a) a tank for said fluid, b) carrying wheels mounted to the fluid tank, c) inlet means to add fluid to said tank, d) dispense means to dispense fluid from said tank, e) charge means to add inert gas to said tank to pressurize same to push fluid therefrom, through said dispense means when it is open and f) means to open and close said dispense means.

2. The fluid cart of claim 1, wherein said tank is pressurized to between 100 and 140 psi by said inert gas.

3. The fluid cart of claim 1, wherein said cart has a handle and a dispense nozzle storage mount.

4. The fluid cart of claim 1, wherein said tank is mounted to a carriage, mounted in turn, to said carrying wheels.

5. The fluid cart of claim 1, wherein said inert gas is $N_2$.

6. The fluid cart of claim 1, wherein said dispensing means includes a hose connected to said tank at one end and to a dispense nozzle at the other end thereof.

7. The fluid cart of claim 1, wherein said fluid tank has at least 30% by volume of said gas in said tank.

8. The fluid cart of claim 7, wherein said fluid tank has at least one quart of oil therein.

9. The fluid cart of claim 7 wherein said fluid tank has at least one quart of hydraulic fluid therein.

10. The fluid cart of claim 1, having at least one fluid dispense counter mounted thereto.

11. The fluid counter of claim 1, wherein said tank is initially pressurized to at least 100 psi.

* * * * *